US005415934A

United States Patent [19]

Mori

[11] Patent Number: 5,415,934

[45] Date of Patent: May 16, 1995

[54] COMPOSITE TEMPERATURE SENSITIVE ELEMENT AND FACE HEAT GENERATOR COMPRISING THE SAME

[76] Inventor: Norio Mori, 3-21-19, Shinkoiwa Katsushika-ku, Tokyo, Japan

[21] Appl. No.: 184,855

[22] Filed: Jan. 21, 1994

Related U.S. Application Data

[63] Continuation of Ser. No. 921,421, Jul. 28, 1992, abandoned, which is a continuation of Ser. No. 449,721, Dec. 11, 1989, abandoned.

[30] Foreign Application Priority Data

Dec. 9, 1988 [JP] Japan ..... 63-309825
Mar. 2, 1989 [JP] Japan ..... 1-48614
Oct. 18, 1989 [JP] Japan ..... 1-270939

[51] Int. Cl.[6] ..... H01B 1/06

[52] U.S. Cl. ..... 428/408; 252/510; 252/511; 219/543; 219/549; 428/240; 428/244; 428/283; 428/290; 428/413; 428/423.1; 428/447; 428/500; 428/521; 428/523; 428/913

[58] Field of Search ..... 428/290, 913, 408, 240, 428/244, 283, 413, 423.1, 447, 500, 521, 523; 252/510, 511; 219/543, 549

[56] References Cited

U.S. PATENT DOCUMENTS

| | | | |
|---|---|---|---|
| 3,178,384 | 4/1965 | Rice et al. | 428/290 |
| 3,808,403 | 4/1974 | Kanaya et al. | 219/549 |
| 3,963,647 | 6/1976 | Straub | 252/511 |
| 3,978,268 | 8/1978 | Kameda et al. | 428/408 |
| 4,058,704 | 11/1977 | Shimizu | 219/549 |
| 4,066,576 | 1/1978 | Bork et al. | 252/511 |
| 4,124,747 | 11/1978 | Muner et al. | 252/511 |
| 4,150,193 | 4/1979 | Burns Jr. | 428/517 |
| 4,151,126 | 4/1979 | Adelman et al. | 252/511 |
| 4,177,446 | 12/1979 | Diaz | 219/549 |
| 4,188,276 | 2/1980 | Lyons et al. | 252/511 |
| 4,244,861 | 1/1981 | Spenadel et al. | 252/511 |
| 4,265,789 | 5/1981 | Christopherson et al. | 428/244 |
| 4,351,747 | 9/1982 | Miyamoto et al. | 252/511 |
| 4,367,398 | 1/1983 | Strube et al. | 219/543 |
| 4,395,362 | 7/1983 | Satoh et al. | 252/511 |
| 4,434,023 | 2/1984 | Kanamori et al. | 428/408 |
| 4,442,139 | 4/1984 | Brigham | 428/408 |
| 4,491,536 | 1/1985 | Tomoda et al. | 252/511 |
| 4,560,498 | 12/1985 | Horsma et al. | 252/511 |
| 4,591,701 | 5/1986 | Tokumaru | 219/543 |
| 4,622,355 | 11/1986 | Arnold, Jr. et al. | 252/500 |
| 4,668,857 | 5/1987 | Smuckler | 219/549 |
| 4,722,860 | 2/1988 | Doljack et al. | 428/244 |
| 4,775,778 | 10/1988 | Van Konynenburg et al. | 219/549 |
| 4,857,384 | 8/1989 | Mio et al. | 428/413 |
| 4,929,388 | 5/1990 | Wessling | 252/511 |

*Primary Examiner*—A. A. Turner
*Attorney, Agent, or Firm*—Adams & Wilks

[57] ABSTRACT

Disclosed is a composite temperature-sensitive element having temperature self-controlling characteristics, which comprises graphite or carbon black, a lowly dimensional substance composed mainly of a cross-linked polymer and a linear polymer, and optionally, an inorganic compound, said lowly dimensional substance and said inorganic compound being conjugated with the graphite or carbon black. In this temperature-sensitive element, the change of the resistance value with the lapse of time is very small even when the element is repeatedly used, stable temperature-electroconductivity characteristics are manifested, there is no risk of local super-heating, and temperature self-detecting and controlling functions are manifested at various stages as the sensor of the molecule level.

Furthermore, this temperature-sensitive element is pliable and shows an excellent elasticity even at the temperature elevation, and the temperature-sensitive element has properties of a flexible elastomer having an appropriate rigidity and can be processed into various shapes. Moreover, the element can be easily prepared at a low cost and it is expected that the element will be widely used in various fields.

19 Claims, 17 Drawing Sheets

COMPOSITE TEMPERATURE SENSITIVE ELEMENT AND FACE HEAT GENERATOR COMPRISING THE SAME

This is a continuation of application Ser. No. 921,421, filed Jul. 28, 1992, which is a continuation of application Ser. No. 449,721, filed Dec. 11, 1989, both now abandoned.

BACKGROUND OF THE INVENTION

1. Field of the Invention

The present invention relates to a novel composite temperature-sensitive element having a function of detecting a specific temperature in a low-temperature region below about 100° C. and a function of self-controlling the temperature and also to a face heat generator comprising this composite temperature-sensitive element.

2. Description of the Prior Art

An electroconductive or semiconductive resin formed by incorporating an electroconductive substance such as graphite, carbon black or a metal powder into a thermosetting resin or thermoplastic resin is widely used as an electronic part or heat generator while utilizing excellent characteristics of the organic material.

However, this product is fatally defective in that the stability is poor and the product has no reliability. Especially, when the electronic part or heat generator is used for a long time, the change with the lapse of time cannot be avoided.

SUMMARY OF THE INVENTION

It is a primary object of the present invention to provide a composite material having an excellent stability, in which stable temperature-electroconductivity characteristics are manifested in a low-temperature region below about 100° C., the electric resistance value is not changed with the lapse of time even when elevation of the temperature and cooling are repeated, and a specific temperature is detected and an excellent function of self-controlling the temperature with a large change of positive characteristics in a specific temperature region.

Another object of the present invention is to provide a safe face heat generator which does not require a complicated temperature-detecting mechanism or a safety fuse for preventing super heating and is easy to handle because the face heat generator has a high pliability.

The present inventor made research with a view to attaining the foregoing objects, and as the result, the following facts were found. More specifically, the present inventor noted that graphite or carbon black has a tight covalent bond structure of a typical two-dimensional six-membered network plane type, and the bonding force between plane layers is relatively weak and slip readily occurs but the adsorbing force is relatively strong and face-to-face swelling and contraction are caused. It also was noted that graphite or carbon black shows an insulating property in the secondary plane as the so-called conjugated covalent bond but shows an electroconductivity between layer planes by the presence of a so-called $\pi$-electron cloud as well as a metal. It was found that if a derivative having adsorption characteristics is adsorbed between layers of graphite or carbon black to expand the spacing between layers and simultaneously, a crystalline low-molecular-weight organic compound is caused to intrude between upper and lower inorganic layers to effect crosslinking by substitution of a part or all of the adsorbed derivative or direct adsorption in the inorganic layer, the resistance to electric conduction between layers can be freely controlled by changing the length of the crosslinked molecule. It also was found that if an inorganic compound such as yttrium oxide is further combined, the property of self-controlling the temperature is prominently improved and this characteristic is further stabilized. The present invention has now been completed based on these findings.

More specifically, in accordance with the present invention, there is provided a composite temperature-sensitive element having temperature self-controlling characteristics, which comprises graphite or carbon black and a substance composed mainly of a crosslinked polymer and a lowly dimensional linear polymer, said lowly dimensional substance being conjugated with the graphite or carbon black.

If a certain inorganic compound is conjugated with the graphite or carbon black together with the lowly dimensional substance composed mainly of a linear polymer, the temperature self-controlling characteristic is further improved and stabilized.

The face heat generator of the present invention is constructed by coating the above-mentioned composite temperature-sensitive element on a fabric substrate.

DETAILED DESCRIPTION OF THE PREFERRED EMBODIMENTS

Figure 1:
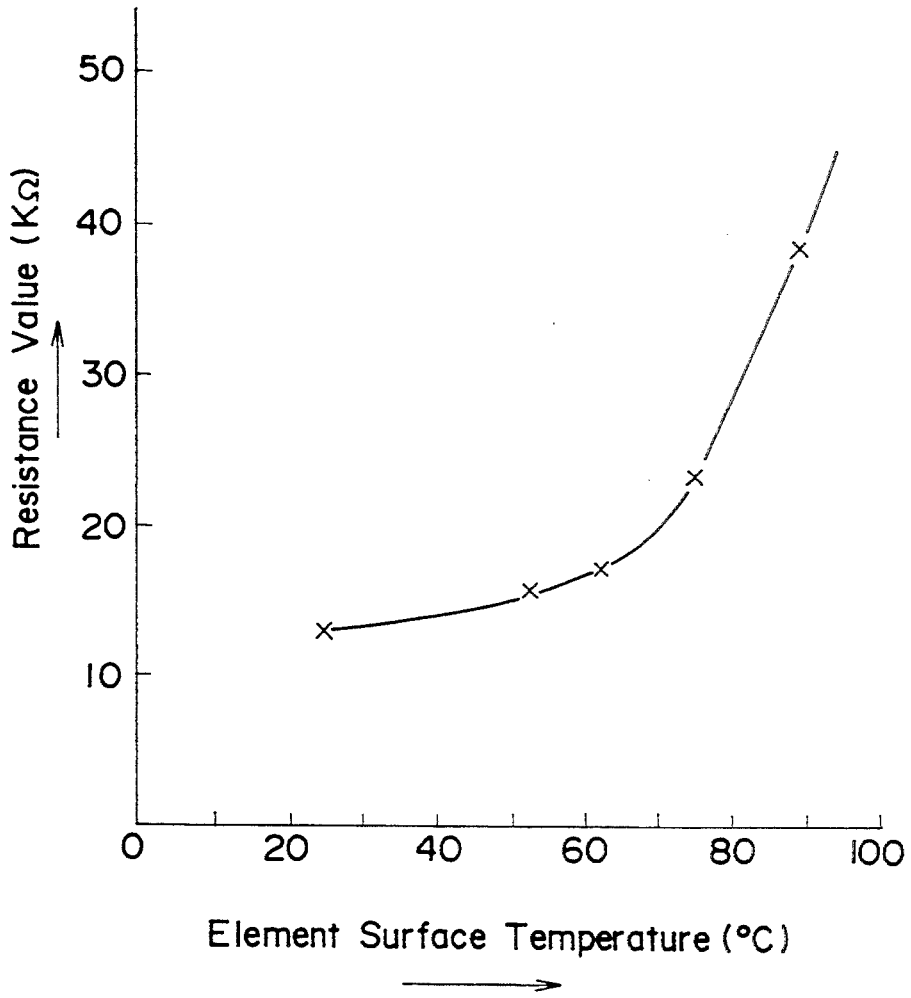
FIG. 1 is a graph illustrating the relation between the element surface temperature and the resistance value in the temperature-sensitive element obtained in Example 1, which was observed when various voltages were applied.

The temperature-sensitive element of the present invention can be prepared by incorporating a monomer of a crosslinked polymer, a fine powder or liquid polymer of a linear polymeric compound as the lowly dimensional compound and a low-molecular-weight organic compound into electroconductive graphite or carbon black, further incorporating an inorganic compound according to need, and blending and polymerizing these components in an organic solvent.

The face heat generator of the present is prepared invention by coating or impregnating a fabric comprising a cotton woven fabric consisting of cotton ply yarns #20 woven at intervals of 1 mm and copper foil lines woven and embedded in the cotton woven fabric with the liquid obtained above by blending and polymerization, and reacting and drying the impregnated or coated fabric.

The substrate of the face heat generator is not limited to the cotton woven fabric, but an organic or inorganic substrate can be used, and any of a plate-shaped substrate, a filmy substrate, a linear substrate, a woven fabric, a nonwoven fabric, a dense substrate, a porous substrate and the like can be used, so far as the temperature self-controlling electroconductive characteristics are not degraded.

In the present invention, natural graphite, artificial graphite, furnace black and acetylene black can be used as the graphite or carbon black. Graphite or carbon black having a particle size smaller than $1\mu$, especially smaller than $0.1\mu$, is preferably used.

A monomer of a thermosetting resin forming a three-dimensional network structure is used as the monomer of the crosslinked polymer. For example, monomers of an epoxy resin, a melamine resin, a polyurethane resin, a silicone resin and modification products thereof are preferably used.

As the linear polymeric compound, there can be mentioned olefin type polymers such as polyethylene, an ethylene/vinyl acetate copolymer, an ethylene/vinyl chloride copolymer and polypropylene, diene type resins such as liquid polybutadiene, and an ionomer resin. Liquid polybutadiene and fine powdery polyethylene having a crystallinity are preferably used.

As typical instances of the low-molecular-weight organic compound, there can be mentioned alkane type linear hydrocarbons having at least 20 carbon atoms and fatty acids thereof.

As the inorganic compound, there can be mentioned alkali metal halides such as sodium chloride, sodium bromide, potassium chloride and potassium bromide, alkali metal sulfates such as sodium sulfate and potassium sulfate, alkaline earth metal carbonates such as barium carbonate, metal halides such as ferric chloride, zinc chloride, titanium tetrachloride and tin tetrachloride, transition metal oxides such as chromium oxide, titanium oxide and zirconium oxide, oxyacids such as nitric acid, and Lewis acids such as antimony chloride.

As the organic solvent or reaction-inducing agent, there can be mentioned aromatic hydrocarbons such as benzene, toluene and xylene, alcohols such as n-butanol and n-propanol, aliphatic glycols such as ethylene glycol, propylene glycol and 1,4-butanediol, alicyclic diols such as cyclopentane-1,2-diol, phenols such as hydroquinone, ketones such as methylethylketone (MEK), and tetrahydrofuran and diethylene glycol monoethyl ether acetate.

In the production of the temperature-sensitive element of the present invention, it is preferred that the mixing ratio of the above-mentioned components be such that the amount of graphite is 10 to 60 parts per 100 parts of the electroconductive highly dimensional substance composed of graphite and the crosslinked polymer and the amount of the crosslinked polymer is 30 to 90 part per 100 parts of the electroconductive highly dimensional substance.

If the amount of the crosslinked polymer exceeds 90 parts, the electroconductivity is degraded, and if the amount of the crosslinked polymer is smaller than 30 parts, that is, the amount of graphite exceeds 70 parts, the bulking effect is not sufficient. The basic electroconductivity at room temperature depends on the kind and quantity of graphite or carbon black, but the mixing ratio of graphite or carbon black can be simply determined relatively to the specific temperature to be detected and the temperature self-controlling characteristics. If the crosslinked polymer is grafted to carbon black, the crosslinked polymer acts as the matrix, and therefore, the basic electroconductivity differs but the mixing ratio of the crosslinked polymer can also be simply determined.

In order to stabilize the electroconductivity, the linear (chain) polymeric compound is preferably incorporated in an amount of 5 to 100 parts per 100 parts of the sum of the amounts incorporated of the crosslinked polymer and graphite. If the amount of the linear polymeric compound exceeds 100 parts, the electroconductivity is drastically reduced and the element cannot be practically used.

The low-molecular-weight organic compound, for example, the above-mentioned hydrocarbon, is incorporated in an amount of 3 to 30 parts. If the amount of the hydrocarbon exceeds 30 parts, the toughness of the product is degraded, and if the amount of the hydrocarbon is smaller than 3 parts, no substantial effect of improving the characteristics can be attained.

The amount incorporated of the inorganic compound is not particularly critical, and the inorganic compound is incorporated in an amount stabilizing and reinforcing the above-mentioned positive characteristics. It is preferred that the inorganic compound be incorporated in an amount of 1 to 20 parts per 100 parts of the sum of the amounts of the crosslinked polymer and graphite. For example, if the amount of yttrium oxide exceeds 20 parts, the toughness of the product is drastically degraded, and if the amount of yttrium oxide is smaller than 1 part, no substantial effect of improving the characteristics can be attained.

The organic solvent should be used in an amount of at least 25 parts, and the amount of the organic solvent can optionally be increased according to the desired degree of dilution.

The temperature-sensitive element of the present invention can be formed by grafting the monomer of the crosslinking polymer to graphite while the above-mentioned components are sequentially mixed and mixing the linear polymeric compound into this monomer. This polymer is entangled and blended with the crosslinked polymer simultaneously with the polymerization of the crosslinked polymer during the heat treatment. This can be confirmed from the fact that the product element is homogeneous. The polymer is also effective for imparting a pliability to the element product and stabilizing the characteristics relatively to formation of a three-dimensional network structure in the crosslinked polymer and the polymerization degree thereof.

Thus, the linear polymeric compound imparts a softness and an entropy rigidity to the three-dimensional network compound which is likely to harden. Furthermore, the linear polymeric compound imparts a flexibility at a low temperature and prevents loosening at a high temperature while imparting a compactness, whereby the entire system can be stabilized.

The low-molecular-weight organic compound and the inorganic compound intrude between the graphite layers directly or in cooperation with the reaction-inducing agent or expand the spacing between the graphite layers, and it is considered that these compounds are strongly absorbed in the graphite layers to form an interlaminar compound.

This is supported by the fact that the temperature-sensitive element of the present invention can endure repeated high-temperature heating (the temperature much higher than the melting point of the low-molecular-weight organic compound, for example, a temperature of up to 130° C. in case of the low-molecular-weight compound having a melting point of 65° C.) and no substantial change of the characteristics is caused.

The inorganic compound has great influence on the specific insulation resistance of the temperature-sensitive element. Accordingly, the temperature elevation characteristics of the temperature-sensitive element of the present invention can be easily changed by addition of the inorganic compound or by omitting the addition. Some inorganic compounds show negative characteristics in a certain initial temperature region, but all of the inorganic compounds show positive characteristics at higher temperatures.

The present invention will now be described in detail with reference to the following examples. Incidentally, in the examples, all of "parts" are by weight.

EXAMPLE 1

| | |
|---|---|
| Carbon black (average particle size smaller than 0.1 | 45 parts |
| Alkyd melamine resin monomer | 55 parts |
| n-Paraffin (fine powder having an average particle size smaller than 5 μ) | 25 parts |
| High-molecular-weight polyethylene (powder having an average particle size smaller than 15 μ) | 25 parts |
| Toluene | 45 parts |
| MEK | 25 parts |
| n-Butanol | 30 parts |

A mixed solution obtained by mixing the above components was a black writing fluid-like liquid, and the liquid was coated on a glass sheet and reacted at a temperature of 155° C. for about 10 minutes under irradiation with far-infrared rays to obtain a coating film having no cracks.

The sample has a specific insulation resistance of $8.5\times10^{-1}$ Ω-cm at 25° C. at an electrode spacing of 60 mm and an electrode length of 23 mm.

A voltage was applied to the element in the state where the upper and lower surfaces of the element were heat-insulated by alumina wool. The electric resistance value of the element just before the application of the voltage was 13.0 kΩ and the surface temperature of the element was 25° C. When an AC voltage of 100 V was applied, the resistance value increased with elevation of the temperature and the resistance value rose to 16.8 KΩ. The temperature was elevated to 62° C. and this temperature was maintained for more than 8000 hours, and no further elevation of the temperature was caused.

When an electric power two times the above-mentioned electric power, that is, an AC voltage of 141 V, was applied to the same test piece, a heat-generating temperature of 75° C. was maintained for a long time and no further elevation of the temperature was caused. The resistance value of the element measured at this temperature was elevated to 23.4 kΩ.

When the application of the voltage to the element was cut and the temperature was returned to normal temperature, 25° C., the resistance value of the element was restored to 13.0 KΩ. When this test was repeated 12 times, the same results were obtained at each test. Accordingly, it was confirmed that the element of this example was a temperature-dependent, temperature self-controlling element.

FIG. 1 is a graph illustrating the relation between the surface temperature and the resistance value, which was observed when various voltages were applied to the temperature-sensitive element obtained in this example.

Figure 2:
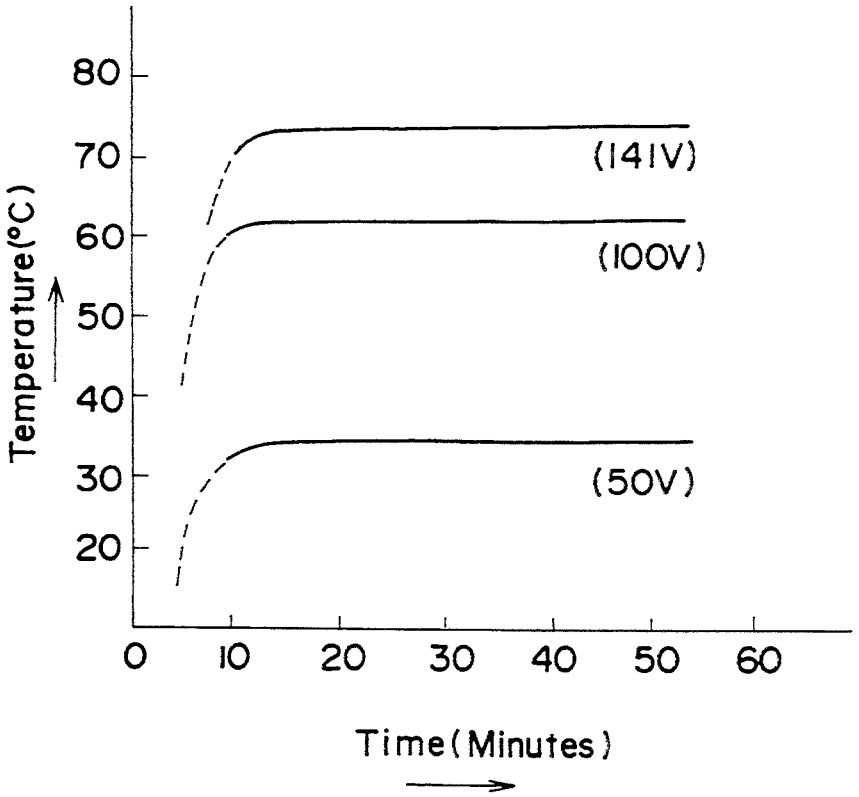
FIG. 2 is a graph illustrating the temperature elevation characteristics of the temperature-sensitive element obtained in Example 1.

FIG. 2 is a graph illustrating the temperature elevation characteristics of the temperature-sensitive element obtained in this example, in which the time (minutes) is plotted on the abscissa and the temperature (°C.) is plotted on the ordinate.

EXAMPLE 2

| | |
|---|---|
| Carbon black (average particle size smaller than 0.1 μ) | 30 parts |
| Acrylic-epoxy resin monomer | 70 parts |
| Ionomer resin | 35 parts |
| n-Paraffin (powder having an average particle size smaller than 5 μ) | 15 parts |
| Xylene | 35 parts |
| MEK | 15 parts |
| n-Butanol | 15 parts |
| Diacetone alcohol | 25 parts |

Figure 3:
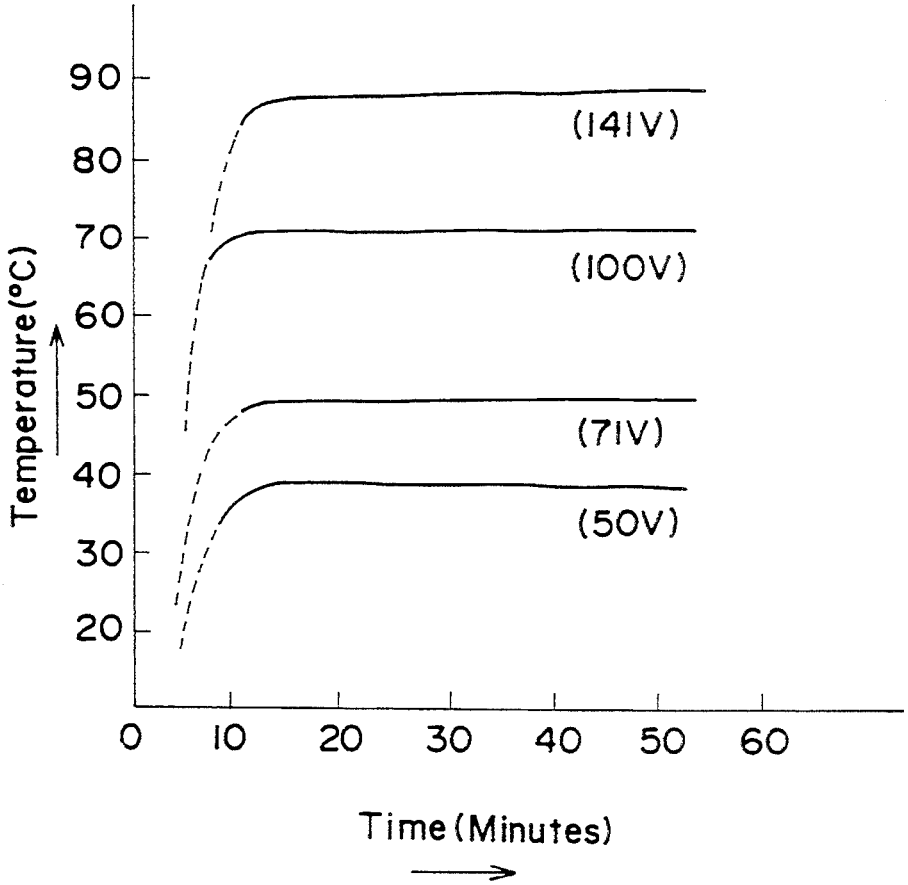
FIG. 3 is a graph illustrating the temperature elevation characteristics of the temperature-sensitive element obtained in Example 2.

A temperature-sensitive element was prepared from the above components in the same manner as described in Example 1. The specific insulation resistance of the sample was $1.9\times10^{-1}$ Ω-cm at 25° C. at an electrode spacing of 60 mm and an electrode length of 23 mm. The temperature elevation characteristics of the sample were as shown in FIG. 3. In the acrylic-epoxy resin, the stability increases with advance of the polymerization degree of the three-dimensional structure, but the element becomes brittle and this is a practically fatal defect. This defect is overcome by incorporation of the ionomer resin having ion bonds.

The ionomer resin acts as a thermoplastic elastomer and imparts a softness to the entire element system while maintaining a stability at a low temperature close to room temperature. Furthermore, the ionomer resin has a good compatibility with the acrylic epoxy resin monomer and they are blended with each other in a very good condition.

EXAMPLE 3

A temperature-sensitive element was prepared in the same manner as described in Example 1 except that, as shown in Table 1, an alkyd melamine resin monomer was used as the crosslinked polymer monomer and the mixing ratio of the monomer to carbon black was changed. The volume resistivity (Ω-cm) at normal temperature was measured.

Furthermore, the mixing ratio of carbon black was kept constant (45 parts) and a phenolic resin monomer or acrylic-epoxy resin monomer was used as the crosslinked polymer monomer, and the volume resistivity (Ω-cm) was measured.

The measurement was carried out in the following manner. Namely, in the same manner as described in Example 1, the mixed liquid was coated on a Pyrex glass sheet (having a thickness of 1 mm) and treated at 155° C. for 10 minutes under irradiation with far-infrared rays to obtain a test piece having an electrode spacing of 60 mm and an electrode length of 10 mm.

Figure 4:
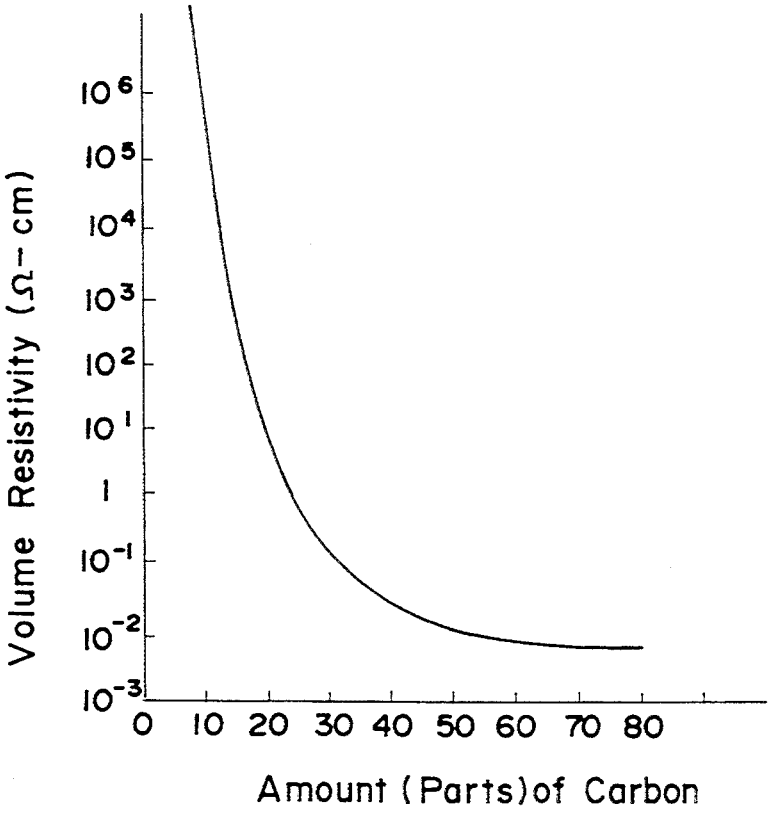
FIG. 4 is a graph illustrating the relation of the alkyd melamine resin/carbon black mixing ratio to the volume resistivity (normal temperature), which was observed in Example 3.

In the case where the alkyd melamine resin monomer was used as the crosslinked polymer monomer, as shown in FIG. 4, if the amount incorporated of carbon black exceeded 50 to 60 parts, the volume resistivity was substantially constant in the respective temperature-sensitive elements, though the value of the volume resistivity differed according to the kind of the crosslinked polymer.

TABLE 1

| Components (Parts) | Run No. 1 | 2 | 3 | 4 | 5 | 6 | 7 |
|---|---|---|---|---|---|---|---|
| Alkyd melamine resin | 90 | 80 | 70 | 50 | 20 | — | — |
| Phenolic resin | — | — | — | — | — | 50 | — |
| Acrylic-epoxy resin | — | — | — | — | — | — | 50 |
| Carbon black | 10 | 20 | 30 | 50 | 80 | 50 | 50 |
| Liquid polybutadiene | 25 | 25 | 25 | — | 25 | — | — |
| High-molecular-weight polyethylene | — | — | — | 25 | — | 25 | 25 |
| Alkane type n-hydrocarbon | 25 | 25 | 25 | 25 | 25 | 25 | 25 |
| Toluene | 60 | 60 | 60 | 45 | 40 | 40 | 40 |
| Xylene | — | — | — | — | 20 | 25 | 25 |
| Methylethylketone (MEK) | 35 | 35 | 35 | 25 | 35 | 40 | 40 |
| n-Butanol | 15 | 15 | 15 | 30 | 15 | 10 | 10 |
| Diacetone alcohol | 15 | 15 | 15 | 25 | 15 | 10 | 10 |
| Volume resistivity (× 10Ω-cm) | $3 \times 10^{6}$ | $4.5 \times 10^{1}$ | $4.4 \times 10^{-1}$ | $2.5 \times 10^{-1}$ | $5.5 \times 10^{-2}$ | $9 \times 10^{-1}$ | $1 \times 10^{-1}$ |

EXAMPLE 4

| | |
|---|---|
| Carbon black (average particle size smaller than 0.1 μ) | 45 parts |
| Alkyd melamine resin monomer | 55 parts |
| Yttrium oxide | 10 parts |
| n-Paraffin (fine powder having an average particle size smaller than 5 μ) | 15 parts |
| High-molecular-weight polyethylene (powder having an average particle size smaller than 15 μ) | 10 parts |
| Liquid polybutadiene | 10 parts |
| Toluene | 45 parts |
| MEX | 25 parts |
| n-Butanol | 30 parts |
| Xylene | 50 parts |

The mixed liquid obtained from the above components was a black writing fluid-like liquid. The mixed liquid was coated on a glass sheet, reacted at 105° C. for about 10 minutes under irradiation with far-infrared rays and fixed at 135° C. for at least about 2 minutes to obtain a coating film having no cracks.

The specific insulation resistance of the obtained sample at 25° C. was $3.6 \times 10^{0}$ Ω-cm at an electrode spacing of 60 mm and an electrode length of 23 mm.

A voltage was applied to the element while the upper and lower surfaces of the element were heat-insulated by alumina wool. The electric resistance value of the element just before the application of the voltage was 26.34 KΩ and the surface temperature was 25° C. When an AC voltage of 100 V was applied to the element, the resistance value increased with elevation of the temperature, and the resistance value rose to 35.0 KΩ. The temperature arrived at 52.5° C. and this temperature was maintained for more than 8000 hours, and no further elevation of the temperature was caused.

When an AC voltage of 141 V was applied to the same test piece, the heat-generating temperature of 75° C. was maintained for a long time and no further elevation of the temperature was caused. The resistance value of the element measured at this temperature was elevated to 49.5 KΩ.

When the application of the voltage to the element was cut and the temperature was returned to normal temperature, 25° C., the resistance value was completely restored to 9.3 KΩ. This test was repeated 12 times, and at the final test, a PET film (supplied by Toray) having a thickness of 62μ was piled on each of the surfaces of the element and heat bonding was carried out at about 115° C. for several seconds. The resistance value at normal temperature (25° C. was precisely restored to 25.40 KΩ. The same results as mentioned above were obtained. Accordingly, it was confirmed that the element of the present example was a stabilized, temperature-dependent, temperature self-controlling element.

Figure 5A:
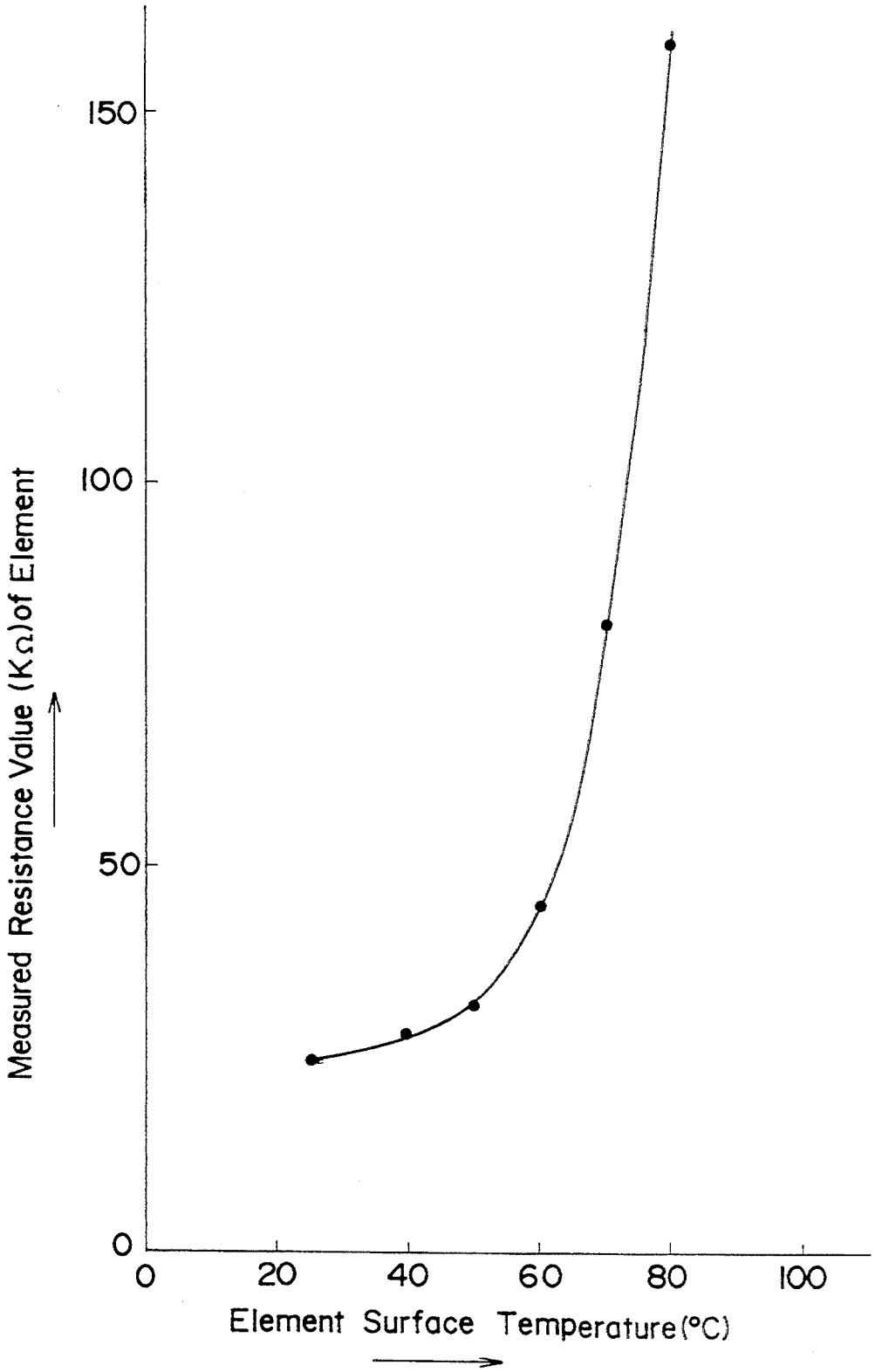
FIG. 5(*a*) is a graph illustrating the relation between the surface temperature measured at the external heating and the resistance value in the temperature-sensitive element obtained in Example 4, and FIG. 5(*b*) is a graph illustrating the fact that a certain (critical) temperature was maintained when various voltages were applied to the temperature-sensitive element obtained in Example 4.
Figure 5B:
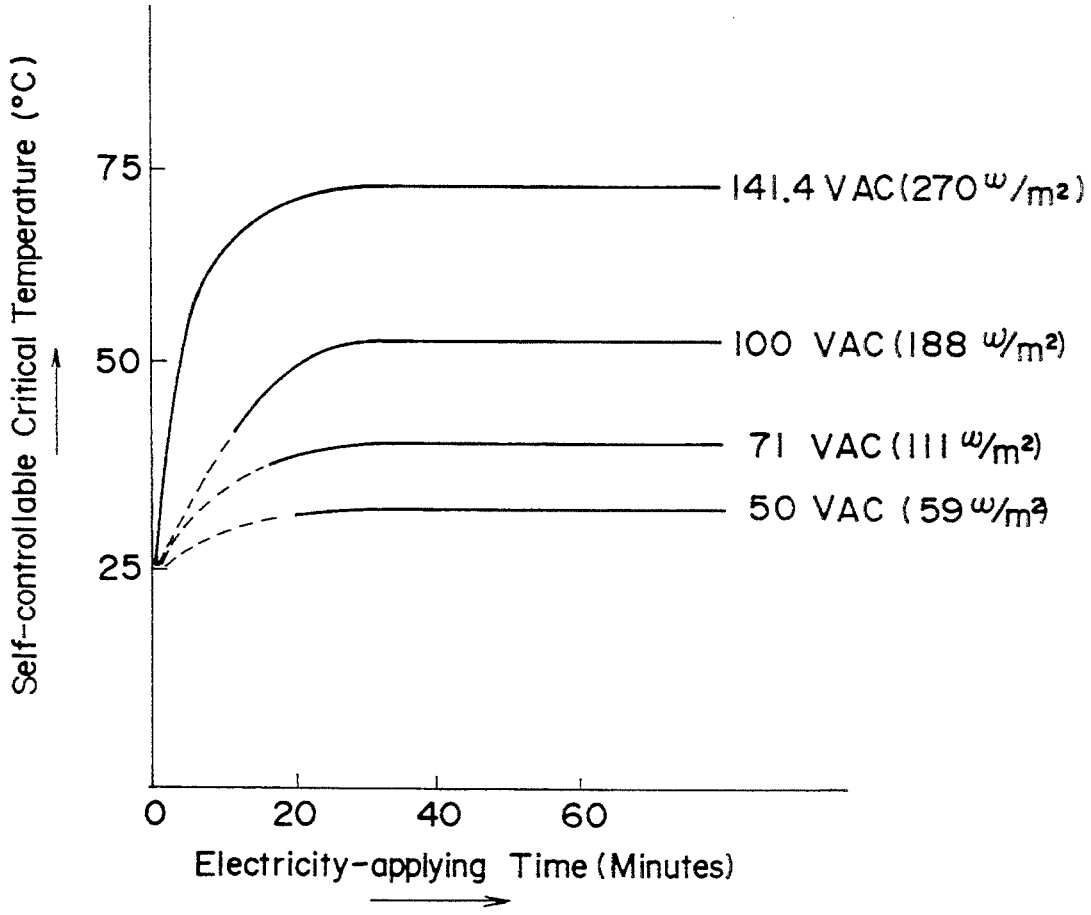

FIG. 5(*a*) is a graph illustrating the relation between the surface temperature and the resistance value, which was observed when the temperature-sensitive element of the present example was externally heated.

FIG. 5(*b*) is a graph illustrating the temperature elevation characteristics of the element of the present invention under application of the voltage, in which the time (minutes) is plotted on the abscissa and the temperature (°C.) is plotted on the ordinate.

EXAMPLE 5

| | |
|---|---|
| Carbon black (average particle size smaller than 0.1 μ) | 30 parts |
| Acrylic-epoxy resin monomer | 70 parts |
| Ionomer resin | 20 parts |
| Yttrium oxide | 10 parts |
| n-Paraffin (powder having an average particle size smaller than 5 μ) | 25 parts |
| Xylene | 35 parts |
| MEX | 15 parts |
| n-Butanol | 15 parts |
| Diacetone alcohol | 25 parts |

A temperature-sensitive element was prepared from the above components in the same manner as described in Example 4. The specific insulation resistance of the test piece at 25° C. was $6.2\times10^{0}$ Ω-cm at an electrode spacing of 60 mm and an electrode length of 23 mm. The temperature elevation characteristics were substantially the same as those obtained in Example 4. In the acrylic-epoxy resin, the stability increases with increase of the polymerization degree of the three-dimensional structure, but the element becomes brittle and this is a practically fatal defect. This defect is overcome by incorporation of the ionomer resin having ion bonds.

The ionomer resin acts as a thermoplastic elastomer and imparts a stability while maintaining a stability in the entire element system at a low temperature close to room temperature. Furthermore, the ionomer resin has a very good compatibility with the acrylic-epoxy monomer and they are blended with each other in good state.

EXAMPLE 6

| | |
|---|---|
| Carbon black (average particle size smaller than 0.1 μ) | 60 parts |
| Alkyd melamine resin monomer | 40 parts |
| n-Paraffin (fine powder having an average particle size smaller than 5 μ) | 30 parts |
| High-molecular-weight polyethylene (powder having an average particle size smaller than 15 μ) | 10 parts |
| Liquid polybutadiene | 20 parts |
| Potassium bromide | 10 parts |
| Toluene | 45 parts |
| MEK | 25 parts |
| n-Butanol | 30 parts |
| Xylene | 40 parts |
| Cyclohexanone | 10 parts |

The mixed solution obtained from the above components was a black writing fluid-like liquid. The mixed solution was coated on a glass sheet and reacted at 155° C. for about 10 minutes under irradiation with far-infrared rays to obtain a coating film having no cracks.

The specific insulation resistance of the sample at 25° C. was $9.8\times10^{-1}$ Ω-cm at an electrode spacing of 30 mm and an electrode length of 23 mm.

The change of the resistance value of the sample at the heating and temperature elevation depended greatly on the teperature. Namely, at temperatures of up to about 50° C., the change ratio of the resistance value was −0.05%/°C. on the average and no substantial change of the resistance value was found. At higher temperatures, the resistance value abruptly increased with elevation of the temperature. When the temperature of the element was returned to normal temperature and the sample was allowed to stand still for more than 10 hours, the resistance value of the element was 172.0 KΩ, which was not substantially different from the resistance value of 169.9 KΩ before the first temperature elevation. Accordingly, it was confirmed that the element was very stable.

Figure 6A:
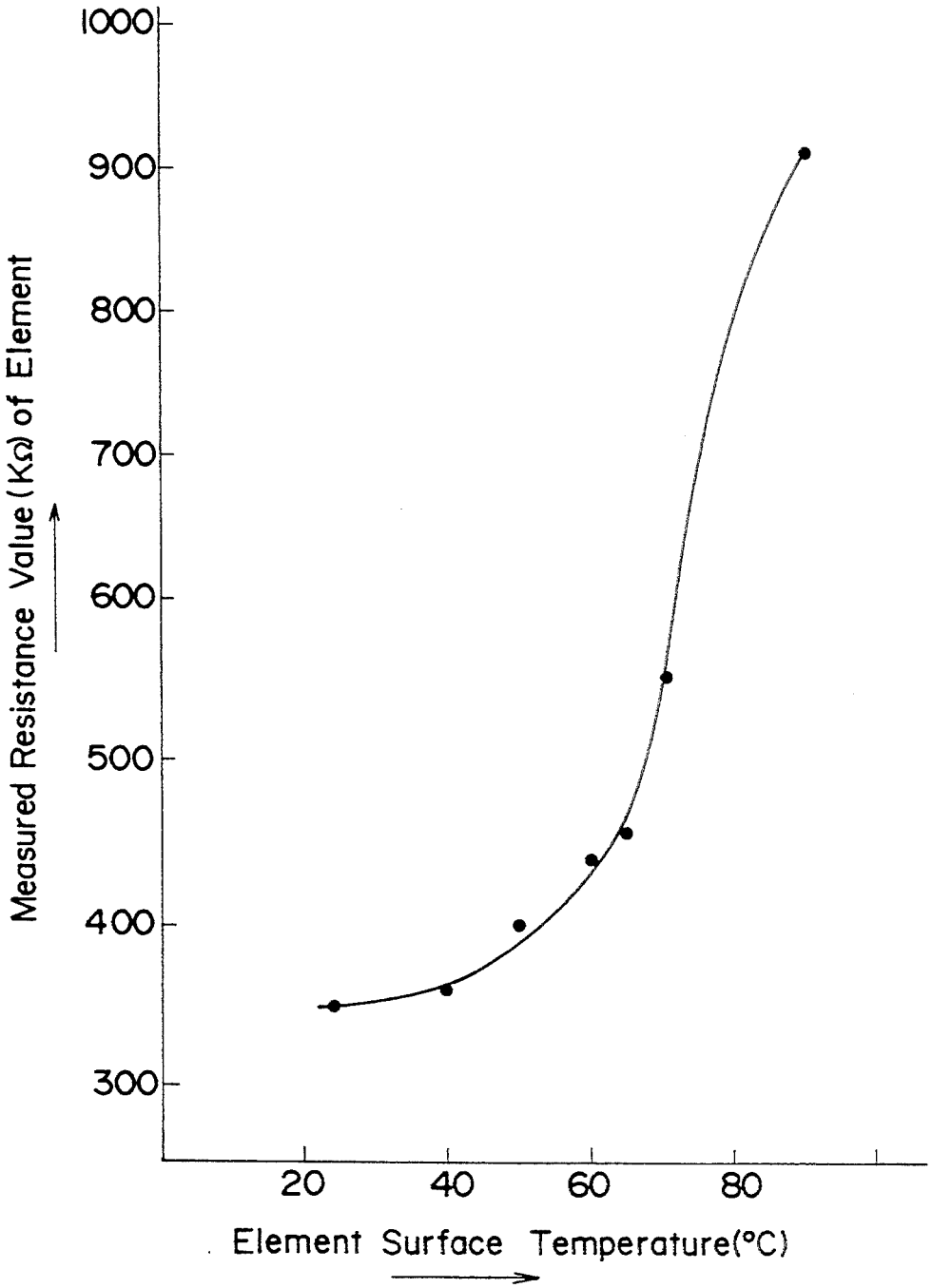
FIGS. 6(*a*) and 6(*b*) through 9(*a*) and 9(*b*) show the results obtained in Examples 6 through 9, respectively, in which (a) is a graph illustrating the relation between the surface temperature measured at the external heating and the resistance value in the temperature-sensitive element and (b) is a graph illustrating the fact that a certain (critical) temperature was maintained when various voltages were applied to the temperature-sensitive element.
Figure 6B:
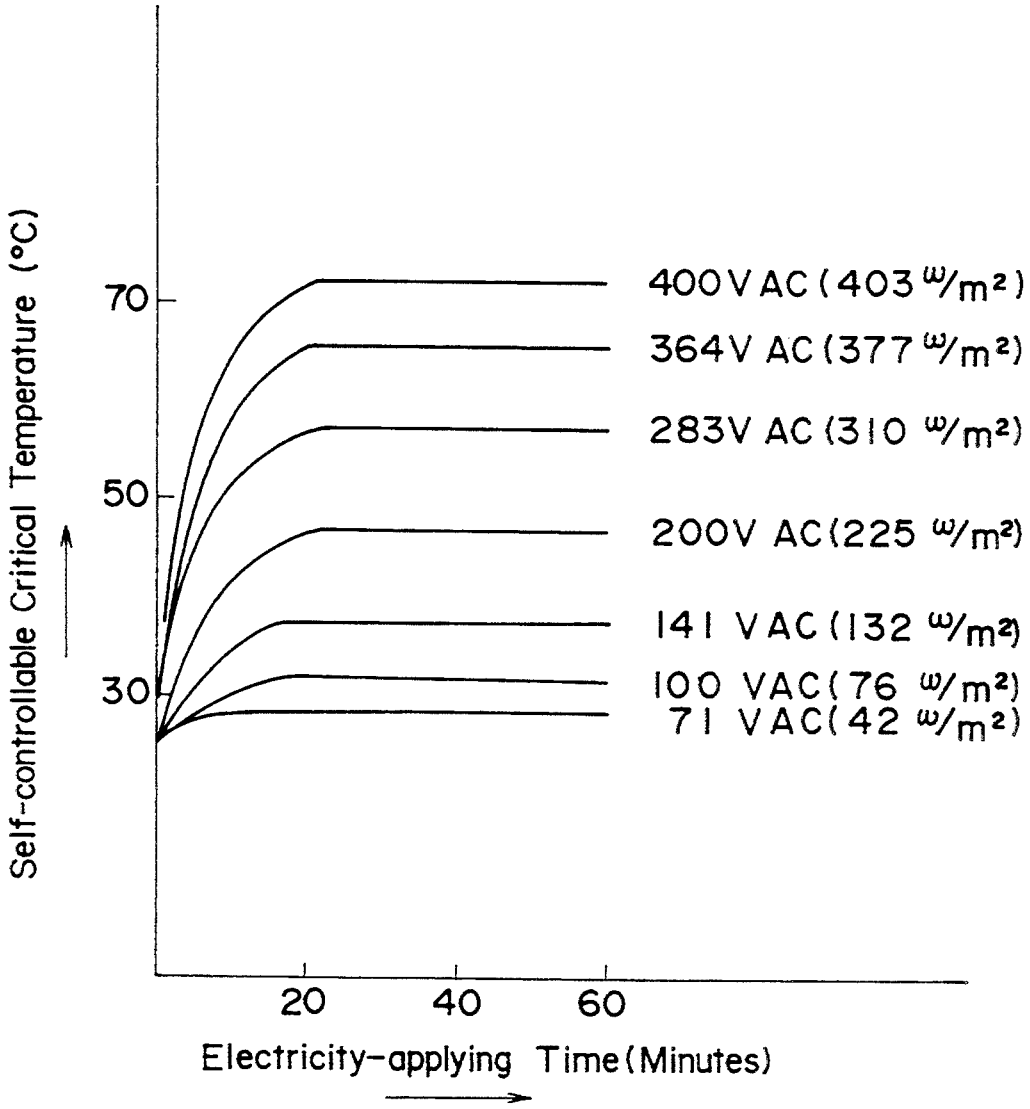

FIG. 6(*a*) is a graph illustrating the relation between the surface temperature and the resistance value in the temperature sensitive element obtained in the present example, and FIG. 6(*b*) is a graph illustrating the temperature elevation characteristics of the element of the present example under application of the voltage. It is seen that a constant temperature was maintained according to the applied voltage.

EXAMPLE 7

An element sample was prepared in the same manner as described in Example 6 except that chromic anhydride ($CrO_3$) was used instead of potassium bromide.

The specific insulation resistance of the sample was 8.7 Ω-cm. As the result of the external heating temperature elevation test, it was found that at temperatures of up to about 50= C., the ratio of the change of the resistance value per 1° C., of the temperature elevation, that is, the temperature coefficient, was 0.61%/°C. on the average, but when the temperature exceeded 50° C., the resistance value abruptly increased to 174 KΩ (85° C.) from 68.0 KΩ (50° C.), and the average change ratio was as high as 4.1%/°C.

When the repeated heating cycle test was carried out 10 times and the sample was allowed to stand at normal temperature for 10 hours, the resistance value at normal temperature was 61.0 KΩ, which was different only by 0.5% from the initial normal temperature resistance value of 60.7 KΩ. Thus, it was confirmed that the sample had an excellent stability.

Figure 7A:
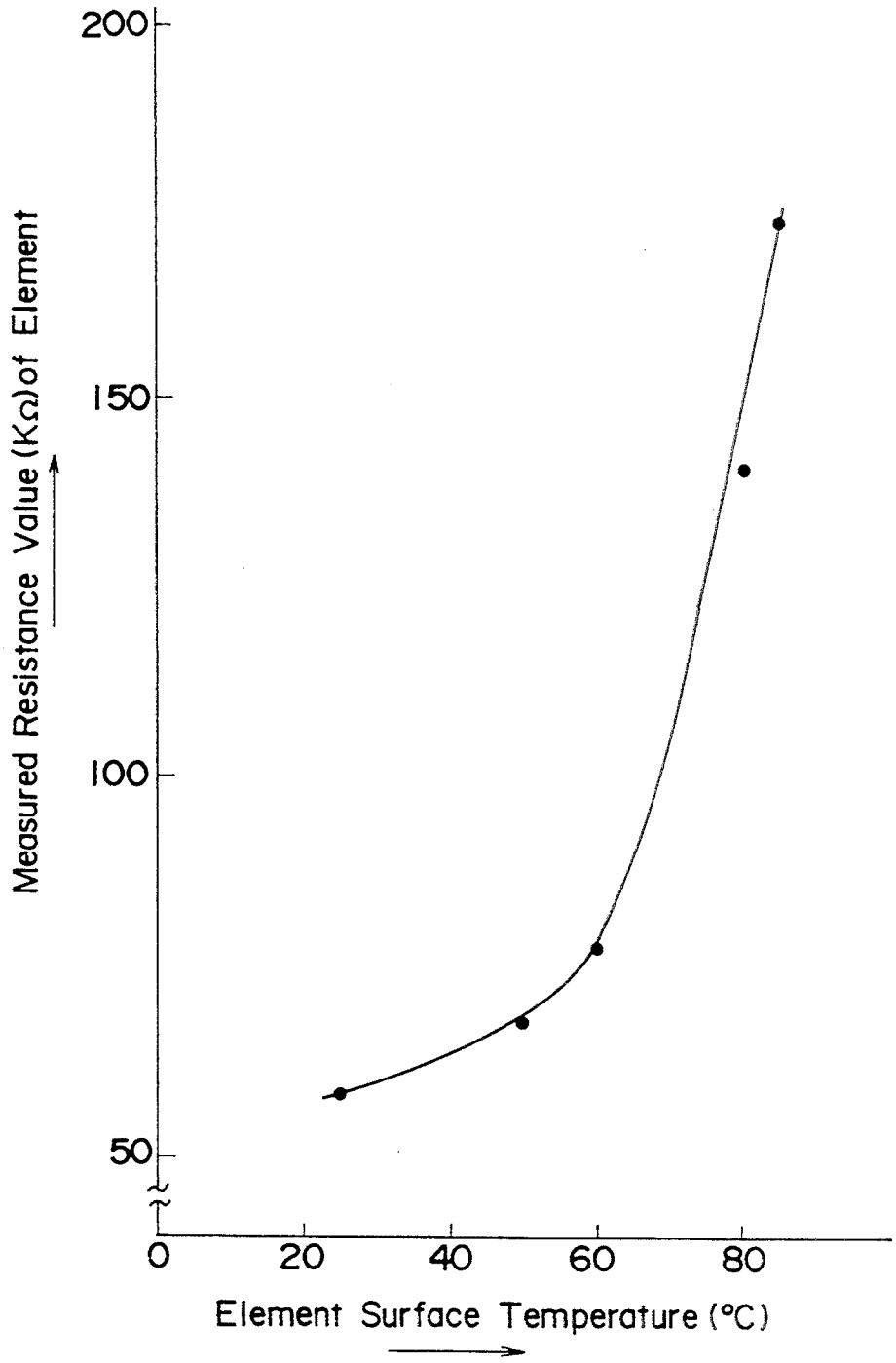
Figure 7B:
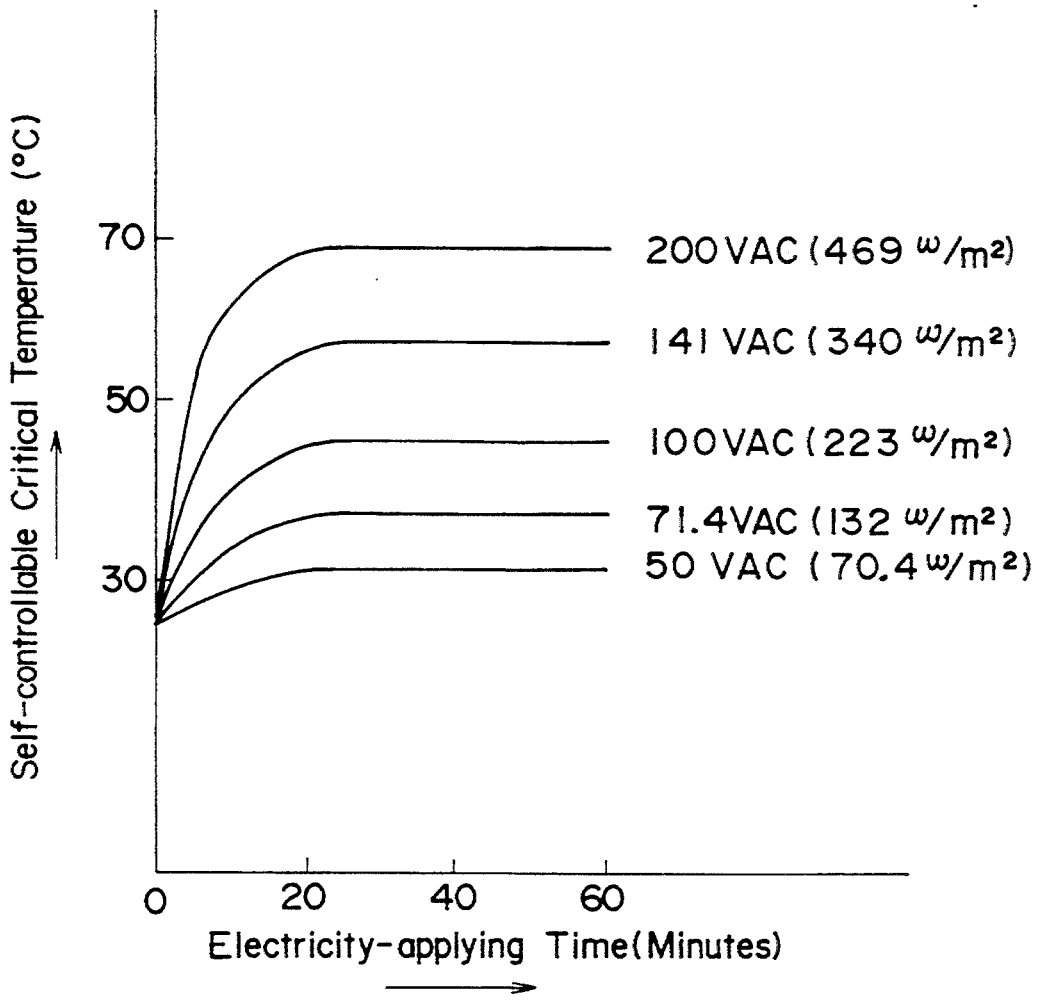

FIGS. 7(*a*) and 7(*b*) are graphs illustrating the temperature elevation characteristics of the temperature-sensitive element obtained in the present example.

EXAMPLE 8

An element sample was prepared in the same manner as described in Example 6 except that barium carbonate ($BaCO_3$) was used instead of potassium bromide.

The specific insulation resistance of this sample was 55 Ω-cm and was higher by two figures than that of the sample obtained by using potassium bromide.

Figure 8A:
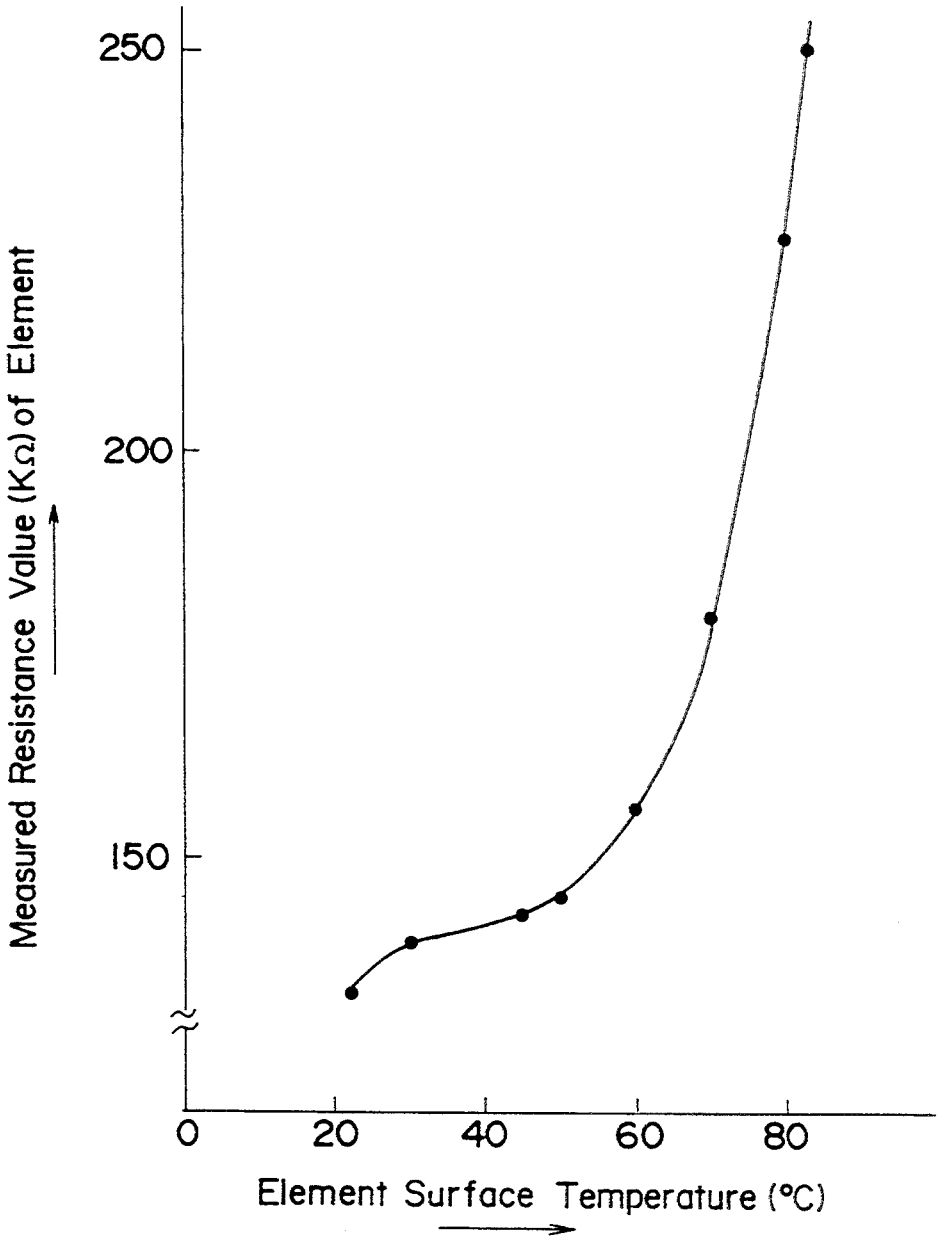
Figure 8B:
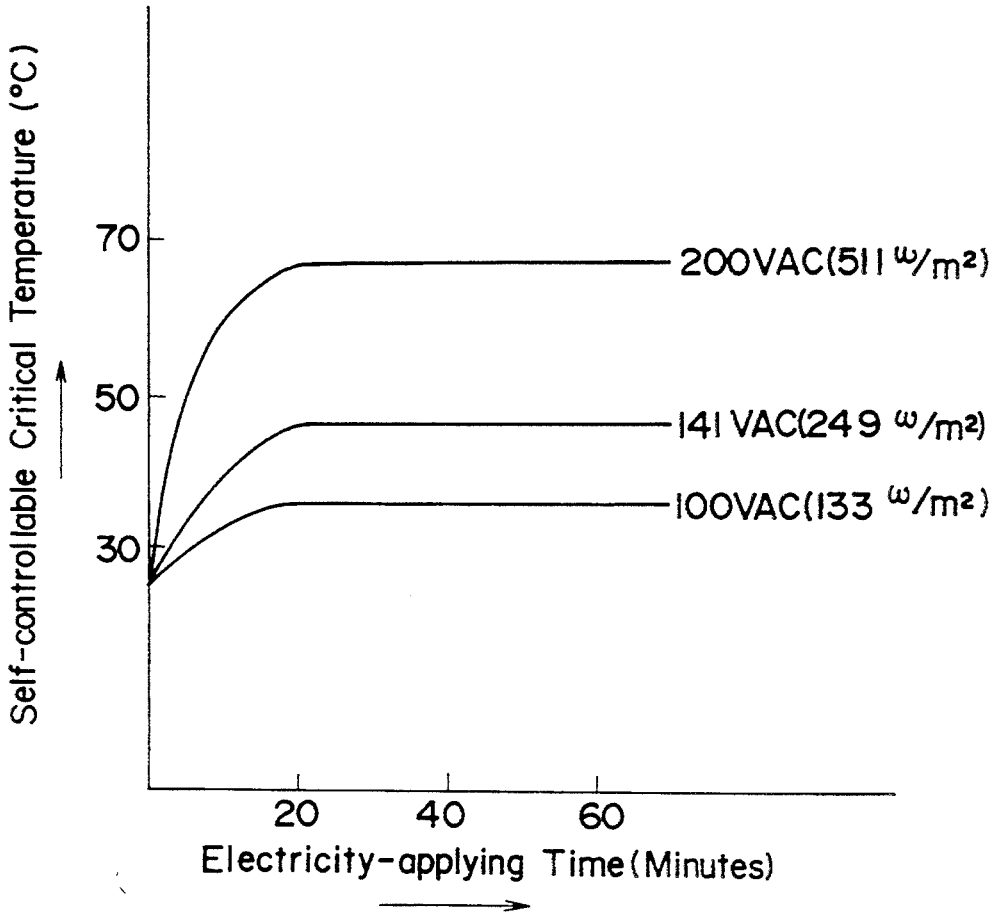

As the result of the heating temperature elevation test, it was found that in the temperature region of from normal temperature to about 50° C., a weak negative characteristic of about −0.5%/°C. was manifested but in the temperature region of from 50° to 90° C., the temperature coefficient was about +2%/°C. When the continuous measurement of the resistance value was carried out, it was found that the resistance value during the cooling step was much lower than during the temperature elevation step, that is, the sample showed strong hysteresis characteristics. However, the resistance value after 10 hours' standing at normal temperature was higher by about 8.7% than the initial resistance value before the temperature elevation and the resistance value was restored to a level higher than the initial value. FIGS. 8(*a*) and 8(*b*) are graphs illustrating the temperature elevation characteristics of the temperature-sensitive element obtained in the present example.

EXAMPLE 9

An element sample was prepared in the same manner as described in Example 6 except that antimony trichloride ($SbCl_3$) was used instead of potassium bromide.

Figure 9A:
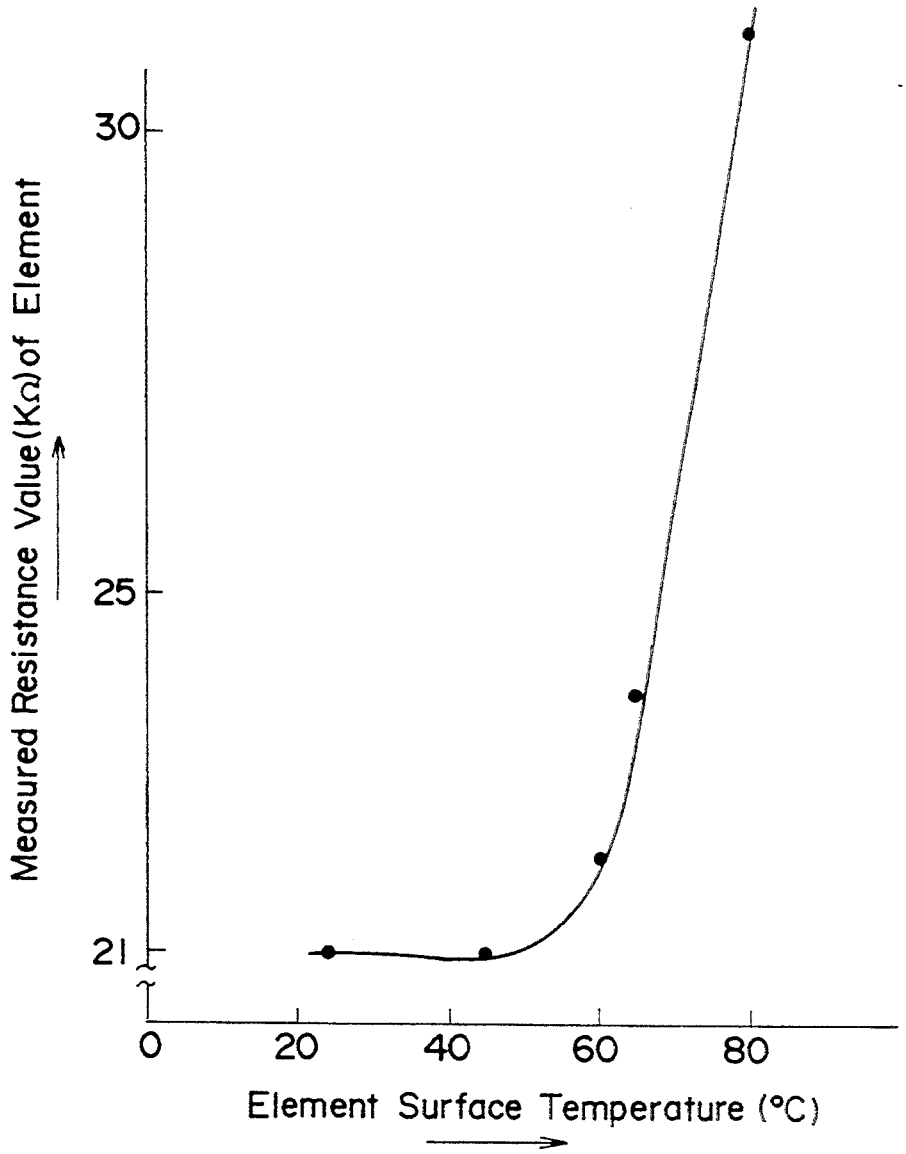
Figure 9B:
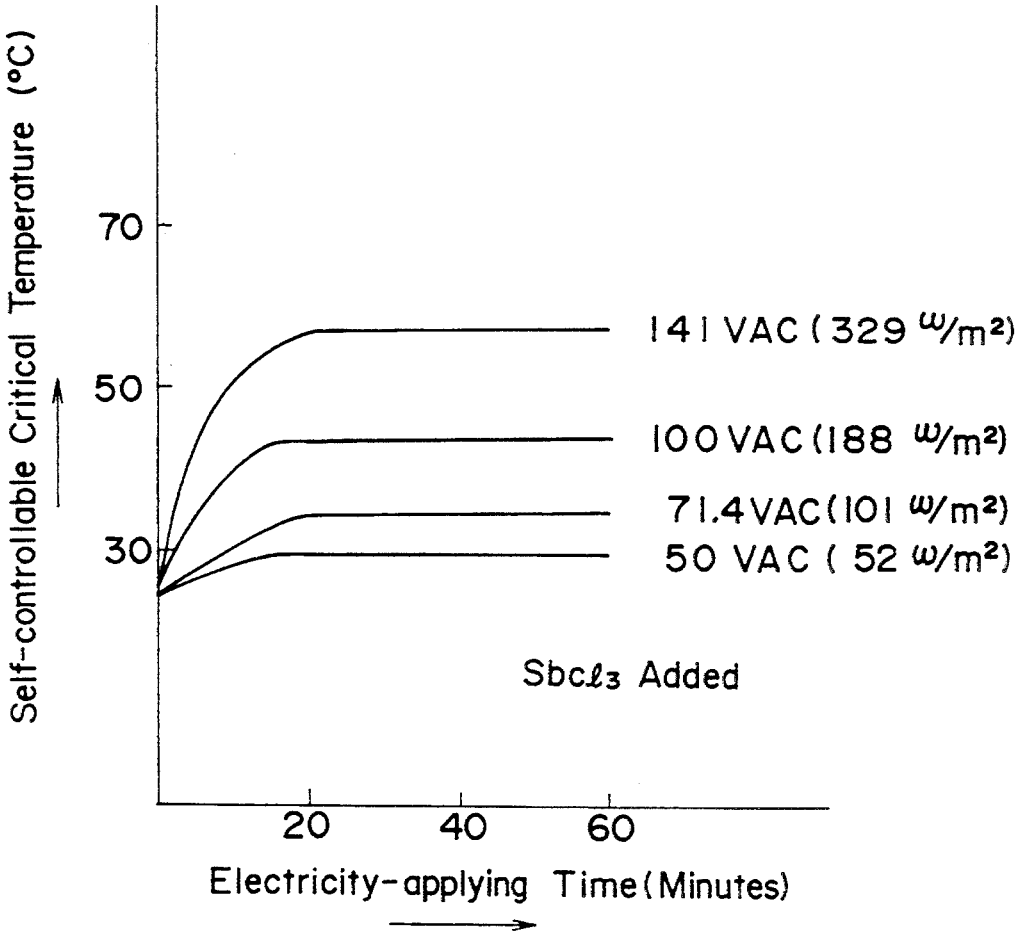

The specific resistance value of the obtained sample was 0.31 Ω-cm. As the result of the heating temperature elevation test, it was found that at temperatures of about 500° C., the resistance value abruptly rose at a temperature coefficient of +0.2%/°C., and the restoration stability of the resistance value at normal temperature was about −0.39% and the stability was very high. FIGS. 9(*a*) and 9(*b*) are graphs illustrating the temperature elevation characteristics of the temperature-sensitive element obtained in the present example.

EXAMPLE 10

Composition of Temperature Self-Controlling Electroconductive Varnish

| | |
|---|---|
| Carbon black (average particle size smaller than 0.1 μ) | 45 parts |
| Alkyd melamine resin monomer | 55 parts |
| n-Paraffin (fine powder having an average particle size-smaller than 5 μ) | 25 parts |
| High-molecular-weight polyethylene (powder having an average particle size smaller than 15 μ) | 25 parts |
| Toluene | 45 parts |
| MEK | 25 parts |
| n-Butanol | 30 parts |

Preparation of Temperature Self-Controlling Face Heat Generator

A test piece for the measurement of the specific insulation resistance was prepared by coating the above composition in a thickness of about 20μ on a commercially available slide glass having a size of 1 mm×76 mm×26 mm by roll ironing, and the coating was dried at room temperature. The coating film was cutt with a width of 10 mm being left. A test piece for measuring the temperature-resistance characteristics and other characteristics was prepared by embedding copper foil lines in a 1 mm-square woven cotton fabric of cotton ply yarns #20, cutting the fabric so that the electrode spacing was 60 mm and the electrode length was 23 mm, impregnating the cut substrate with the above-mentioned composition, pressing the impregnated substrate by two silicone rubber rolls (hardness=50, compression pressure=1 kgf) and drying the coated substrate at room temperature.

Characteristic Tests and Results

The mixed solution prepared from the above components was a black writing fluid-like liquid. The mixed solution was coated on each sample substrate and reacted at 155° C. for 10 minutes under irradiation with far-infrared rays to form a coating film having no cracks.

The sample on the glass sheet had a specific insulation resistance of $8.5\times10^{-1}$ Ω-cm at 25° C.

A voltage was applied to the sample element formed by using the cotton fabric substrate in the state where the upper and lower surfaces were heat-insulated by alumina wool. The resistance value of the element was 13.0 KΩ just before the application of the voltage and the element surface temperature was 25° C. When a AC voltage of 100 V was applied, the resistance value was increased to 16.8 KΩ in proportion to the elevation of the temperature. The temperature reached 62° C. and this temperature was maintained for more than 8000 hours, and no further temperature elevation was caused.

When an electric power 2 times as large as the above-mentioned electric power, that is, an AC voltage of 141 V, was applied, the heat-generating temperature of 75° C. was maintained for a long time and no further temperature elevation was caused. The resistance value of the element measured at this temperature was increased to 23.4 KΩ.

When the application of the voltage to the sample element was cut and the temperature was returned to normal temperature, 25° C., the resistance value of the element was completely restored to 13.0 KΩ. When this test was repeated 12 times, the same results were obtained at each test. Accordingly, it was confirmed that the element formed by using the above-mentioned composition was a completely stabilized, temperature-dependent, temperature self-controlling element.

Figure 10:
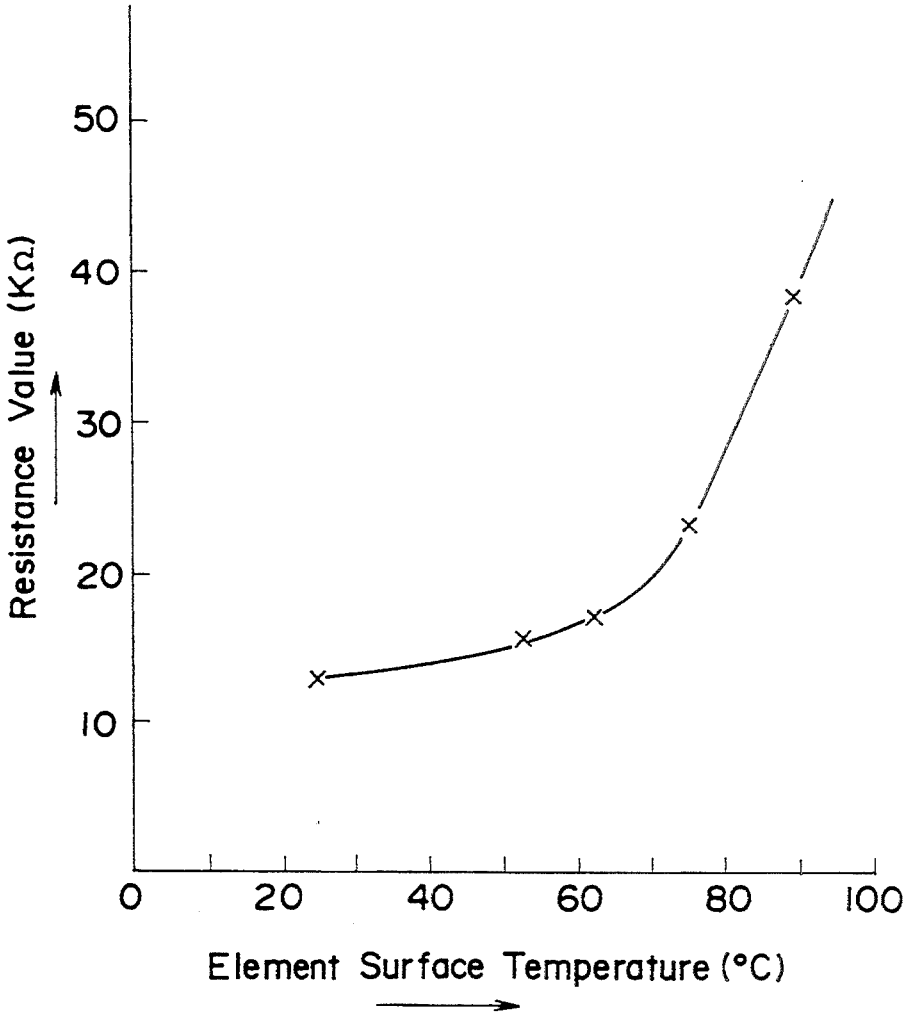
FIG. 10 is a graph illustrating the relation between the surface temperature and the resistance value, which was observed when various voltages were applied to the face heat generator obtained in Example 10.

FIG. 10 is a graph illustrating the relation between the element surface temperature and the resistance value, which was observed when various voltages were applied to the sample element obtained in the present example.

Figure 11:
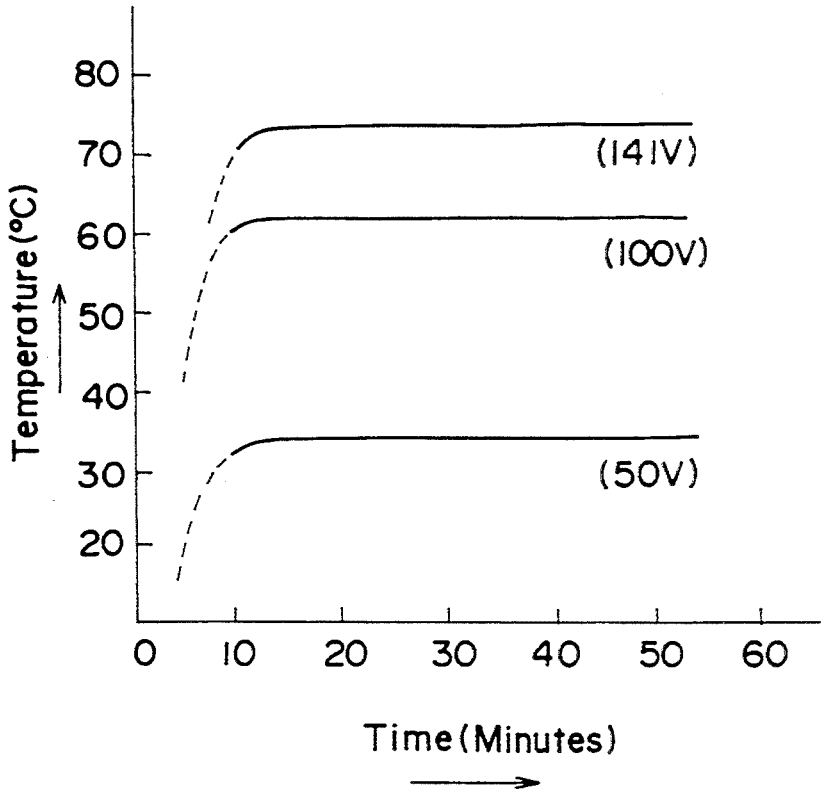
FIG. 11 is a graph illustrating the temperature elevation characteristics of the face heat generator obtained in Example 10.

FIG. 11 is a graph illustrating the temperature elevation characteristics of the sample element obtained in the present example, in which the time (minutes) is plotted on the abscissa and the temperature (°C.) is plotted on the ordinate.

EXAMPLE 11

Composition of Temperature Self-Controlling Electroconductive Varnish

| | |
|---|---|
| Carbon black (average particle smaller than 0.1 μ) | 30 parts |
| Acrylic-epoxy resin monomer | 70 parts |
| Ionomer resin | 35 parts |
| n-Paraffin (powder having an average particle size smaller than 5 μ) | 15 parts |
| Xylene | 35 parts |
| MEK | 15 parts |
| n-Butanol | 15 parts |
| Diacetone alcohol | 25 parts |

Preparation of Face Heat Generator Sample and Characteristic Tests

Figure 12:
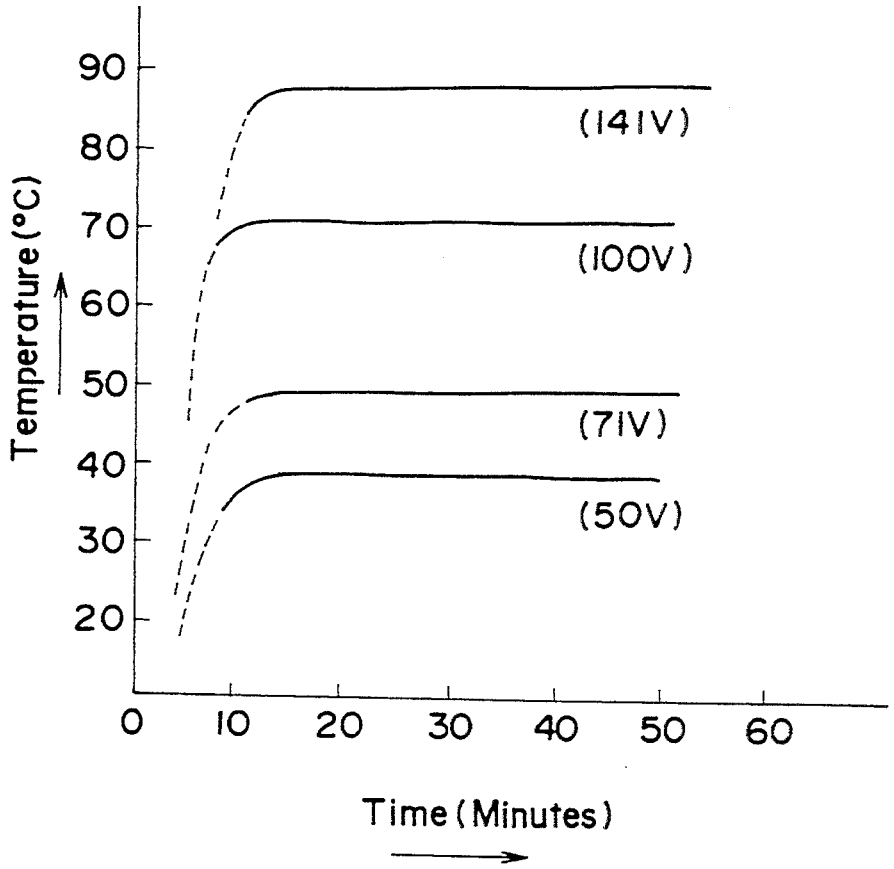
FIG. 12 is a graph illustrating the temperature elevation characteristics of the face heat generator obtained in Example 11.

A face heat generator was prepared from the above composition in the same manner as described in Example 10. The specific insulation resistance of the sample was $1.9\times10^{-1}$ Ω-cm at 25° C. The temperature elevation characteristics were as shown in FIG. 12. The stability of the acrylic-epoxy resin increases with advance of the polymerization degree of the three-dimensional structure, but the face heat generator becomes brittle and this is a practically fatal defect. This defect is overcome by incorporation of the ionomer resin having ion bonds.

The ionomer resin acts as a thermoplastic elastomer and imparts a softness to the entire element system at a low temperature close to room temperature while maintaining a safety. The ionomer resin has a very good compatibility with the acrylic-epoxy resin monomer and they are mixed with each other in a very good state.

As is apparent from the foregoing description, the temperature-sensitive element and face heat generator of the present invention are characterized in that the change of the resistance value with the lapse of time is very small even when the element and heat generator are repeatedly used, stable temperature-electroconductivity characteristics are manifested, there is no risk of local super-heating, and temperature self-detecting and controlling functions are manifested at various stages as the sensor of the molecule level.

Furthermore, this temperature-sensitive element is pliable and shows an excellent elasticity even at the temperature elevation, and the temperature-sensitive element has properties of a flexible elastomer having an appropriate rigidity and can be processed into various shapes. Moreover, the element can be easily prepared at a low cost and it is expected that the element will be widely used in various fields.

What is claimed is:

1. A composite temperature-sensitive element having temperature self-controlling characteristics, which comprises the reaction product of a composition obtained by mixing electroconductive graphite or carbon black with components comprising a monomer of a crosslinked polymer, a pre-formed linear polymeric compound as a lowly-dimensional compound, and a low-molecular-weight alkane linear organic compound, wherein said crosslinked polymer is 30 to 90 parts and graphite or carbon black is 10–60 parts per 100 parts of the sum of the crosslinked polymer and said graphite or carbon black, said linear polymeric compound is 5–100 parts per 100 parts of the sum of the crosslinked polymer and said graphite or carbon black, and said low-molecular-weight organic compound is 3 to 30 parts, and wherein said crosslinked polymer is a thermosetting resin forming a three-dimensional network structure and said reaction product contains the linear polymeric compound entangled and blended with the graphite or carbon black and crosslinked polymer.

2. A composite temperature-sensitive element having temperature self-controlling characteristics, which comprises the reaction product of a composition obtained by mixing electroconductive graphite or carbon black with components comprising a monomer of a crosslinked polymer, a pre-formed linear polymeric compound as a lowly-dimensional compound, and a low-molecular-weight alkane linear organic compound, wherein said crosslinked polymer is 30 to 90 parts and graphite or carbon black is 10–60 parts per 100 parts of the sum of the crosslinked polymer and said graphite or carbon black, said linear polymeric compound is 5–100 parts per 100 parts of the sum of the crosslinked polymer and said graphite or carbon black, and said low-molecular-weight organic compound is 3 to 30 parts and further comprises an inorganic compound, and said inorganic compound being present in the amount of 1 to 20 parts per 100 parts of the sum of the amounts of said crosslinked polymer and graphite or carbon black, and wherein said crosslinked polymer is a thermosetting resin forming a three-dimensional network structure and said reaction product contains the linear polymeric compound entangled and blended with the graphite or carbon black and crosslinked polymer.

3. A face heat generator which comprises a fabric substrate coated with a temperature-sensitive element or resistance heat-generating element having temperature self-controlling characteristics, wherein said temperature-sensitive element or resistance heat-generating element comprises the reaction product of a composition obtained by mixing electroconductive graphite or carbon black with components comprising a monomer of a crosslinked polymer, a pre-formed linear polymeric compound as a lowly-dimensional compound, and a low-molecular-weight alkane linear organic compound, wherein said crosslinked polymer is 30 to 90 parts and graphite or carbon black is 10–60 parts per 100 parts of the sum of the crosslinked polymer and said graphite or carbon black, said linear polymeric compound is 5–100 parts per 100 parts of the sum of the crosslinked polymer and said graphite or carbon black, and said low-molecular-weight organic compound is 3 to 30 parts, and wherein said crosslinked polymer is a thermosetting resin forming a three-dimensional network structure and said reaction product contains the linear polymeric compound entangled and blended with the graphite or carbon black and cross linked polymer.

4. A face heat generator which comprises a fabric substrate coated with a temperature-sensitive element or resistance heat-generating element having temperature self-controlling characteristics, wherein said temperature-sensitive element or resistance heat-generating element comprises the reaction product of a composition obtained by mixing electroconductive graphite or carbon black with components comprising a monomer of a crosslinked polymer, a pre-formed linear polymeric compound as a lowly-dimensional compound, and a low-molecular-weight alkane linear organic compound, wherein said crosslinked polymer is 30 to 90 parts and graphite or carbon black is 10–60 parts per 100 parts of the sum of the crosslinked polymer and said graphite or carbon black, said linear polymeric compound is 5–100 parts per 100 parts of the sum of the crosslinked polymer and said graphite or carbon black, and said low-molecular-weight organic compound is 3 to 30 parts and further comprises and inorganic compound and said inorganic compound being conjugated with the graphite or carbon black, said inorganic compound being present in the amount of 1 to 20 parts per 100 parts of the sum of the amounts of said crosslinked polymer and graphite or carbon black, and wherein said crosslinked polymer is a thermosetting resin forming a three-dimensional network structure and said reaction product contains the linear polymeric compound entangled and blended with the graphite or carbon black and crosslinked polymer.

5. A composite temperature-sensitive element as defined in claim 1, wherein said linear polymeric compound is polyethylene, ethylene/vinyl acetate copolymer, ethylene/vinyl chloride copolymer, polybutadiene, polypropylene, or an ionomer resin.

6. A composite temperature-sensitive element as defined in claim 2, wherein said linear polymeric compound is polyethylene, ethylene/vinyl acetate copolymer, ethylene/vinyl chloride copolymer, polybutadiene, polypropylene, or an ionomer resin.

7. A face heat generator as defined in claim 3, wherein said linear polymeric compound is polyethylene, ethylene/vinyl acetate copolymer, ethylene/vinyl chloride copolymer, polybutadiene, polypropylene, or an ionomer resin.

8. A face heat generator as defined in claim 4, wherein said linear polymeric compound is polyethylene, ethylene/vinyl acetate copolymer, ethylene/vinyl chloride copolymer, polybutadiene, polypropylene, or an ionomer resin.

9. A composite temperature-sensitive element as defined in claim 2, wherein said inorganic compound is an alkali metal halide, an alkali metal sulfate, an alkaline earth metal carbonate, a metal halide, a transition metal oxide, an oxyacid, yttrium oxide or a Lewis acid.

10. A face heat generator as defined in claim 4, wherein said inorganic compound is an alkali metal halide, an alkali metal sulfate, an alkaline earth metal carbonate, a metal halide, a transition metal oxide, an oxyacid, yttrium oxide or a Lewis acid.

11. A composite temperature-sensitive element as defined in claim 9, wherein said inorganic compound is yttrium oxide.

12. A face heat generator as defined in claim 10, wherein said inorganic compound is yttrium oxide.

13. A face heat generator as defined in claim 3, wherein said fabric substrate is cotton woven fabric.

14. A face heat generator as defined in claim 4, wherein said fabric substrate is cotton woven fabric.

15. An element as defined in claim 1, wherein said polymeric compound is polyethylene.

16. An element as defined in claim 2, wherein said polymeric compound is polyethylene.

17. An element as defined in claim 3, wherein said polymeric compound is polyethylene.

18. An element as defined in claim 4, wherein said polymeric compound is polyethylene.

19. An element as defined in claim 11, wherein said polymeric compound is polyethylene.

* * * * *